US005108110A

United States Patent [19]

Nerbas

[11] Patent Number: 5,108,110

[45] Date of Patent: Apr. 28, 1992

[54] GAME APPARATUS

[76] Inventor: Donald E. Nerbas, Box 847, Yorkton, Saskatchewan, Canada, S3N 2W8

[21] Appl. No.: 751,530

[22] Filed: Aug. 29, 1991

[51] Int. Cl.[5] ..... A63F 3/00

[52] U.S. Cl. ..... 273/244

[58] Field of Search ..... 273/243, 244, 245, 246, 273/247, 259

[56] References Cited

U.S. PATENT DOCUMENTS

| | | | |
|---|---|---|---|
| D. 185,037 | 4/1959 | Peters . | |
| D. 245,718 | 9/1977 | Maloney, II . | |
| D. 294,720 | 3/1988 | MacDowell . | |
| 780,937 | 1/1905 | Clagett . | |
| 821,881 | 5/1906 | Pell et al. . | |
| 3,907,295 | 9/1975 | Eissler | 273/244 |
| 4,010,957 | 3/1977 | Tricoli | 273/244 |
| 4,027,882 | 6/1977 | Rosenberg | 273/247 |
| 4,486,022 | 12/1984 | Dixon | 273/244 X |

FOREIGN PATENT DOCUMENTS

| | | | |
|---|---|---|---|
| 1186708 | 5/1985 | Canada | 273/244 |
| 1206986 | 7/1986 | Canada | 273/244 |
| 600539 | 4/1948 | United Kingdom | 273/244 |
| 2207609 | 2/1989 | United Kingdom | 273/259 |

*Primary Examiner*—Edward M. Coven
*Assistant Examiner*—William E. Stoll
*Attorney, Agent, or Firm*—Murray E. Thrift; Stanley G. Ade; Adrian D. Battison

[57] ABSTRACT

An apparatus and method are provided for playing a multi-participant game related to a team sport. The apparatus includes a set of player cards, each identifying a player, a team and the player's position. A set of position cards identifying the various player positions on a team is also provided. The game is played on a game board with a track marked up in playing areas. As a participant advances a token along the track under the direction of a chance device, the token will land on playing areas representing the player cards, allowing the player to accumulate a set of players. Other playing areas will allow the player to move cards from a practice roster to an active roster and to trade player cards with other players. When a token lands at the end of the track, the participant draws a card from the position deck and, if he has an active player with that position, he may complete that player. The winner of the game is the first participant to generate a full complement of completed players from a single team.

21 Claims, 2 Drawing Sheets

GAME APPARATUS

FIELD OF THE INVENTION

The present invention relates to a game, and more particularly to a game such as a board game for multiple participants.

BACKGROUND OF THE INVENTION

A game according to the invention relates to a team sport, although it does not simulate the play of the sport. It is instead based on the collection of players to form a full complement of players from a single team. The team sport in the embodiment described in the following is ice hockey, although other sports may also be represented.

In describing the invention, the term "participant" is used to designate a person actually participating in the game, while the term "player" is used to designate a player in the team sport to which the game relates, e.g. an ice hockey player.

In team sports, each team has a set number of players who will be playing at any one time. For example, ice hockey will have 18, 6 players on the ice at any given time barring penalties. The number playing at any given time is referred to in this application as a "complement". A complement includes a player for each position. In ice hockey, this would include goal tender, two defence men, a left wing forward, a right wing forward and a centre forward.

The objective of the present invention is for a participant to accumulate a complement of players from one team.

SUMMARY OF THE INVENTION

According to one aspect of the present invention there is provided an apparatus for playing a multiple participant game related to a team sport, said apparatus comprising:

- player record means recording a plurality of players comprising a plurality of teams, and recording a team and a position for each player;
- player acquisition means for randomly acquiring individual players from the player record means;
- position record means recording each position in a complement of players;
- position designation means for randomly designating individual positions from the position record means;
- track means comprising a plurality of sequential playing areas;
- participant token means representing each participant;
- chance means operable to produce a random representation of movement of the token means along the track;
- player addition indicia associated with selected ones of the playing areas of the track for directing transfer of a player acquired by the player acquisition means from the player record means to a participant roster; and
- position selection indicia associated with at least one of the playing areas for directing the designation of a position with the position designation means.

In preferred embodiments of the invention, the playing areas along the track are marked to direct the player of the game. The track may include areas for player acquisition, player activation, position selection, trading, penalties and directing movement along the track either forwards or back.

The game was originally designed as a board game, although it is anticipated that could be translated into other versions, for example a software version if desired.

For player selection and position determination, the apparatus may include a set of player cards and a set of position cards. The card sets may be shuffled and stacked for cards to be drawn from the top of the set when required.

The position selection is preferably only at a final playing area along the track.

The term "random" is used here in a general sense and is intended to include both true random and pseudo-random.

According to another aspect of the present invention there is provided a method of playing a multiple participant game related to a team sport, said method comprising:

(a) providing a playing track comprising a plurality of sequential playing areas including a plurality of player addition areas and at least one position selection area; a plurality of sets of participant tokens, one set for each participant; player record means recording each player, the player's team and the player's position; position designation means for randomly designating the player positions; and a chance device;

(b) for a first participant, actuating the chance device to produce token movement data;

(c) moving a token of the first participant along the track according to the data produced by the chance device;

(d) if the token falls on a player addition area, selecting a player from the player record means and adding the player to a roster assigned to the first participant;

(e) if the token falls on a position selection area, designating a player position with the player position designation means;

(f) selecting a player of the same position as the designated position from the roster assigned to the first participant and transferring that player to a player complement of the first participant;

(g) repeating steps (b) to (f) for each participant and repeating the sequence until one participant has completed a complement of players from the same team.

In preferred embodiments, the playing areas are designated as described above and the method includes placing a newly drawn player on a practice roster until a token lands on a player activation area, when the player may be transferred to an active roster. A new token may be started on the track when a player is transferred to the active roster.

Further details of the game and the preferred embodiment will become more apparent from the following.

BRIEF DESCRIPTION OF THE DRAWINGS

In the accompanying drawings which illustrate an exemplary embodiment of the present invention.

DETAILED DESCRIPTION

Figure 1:
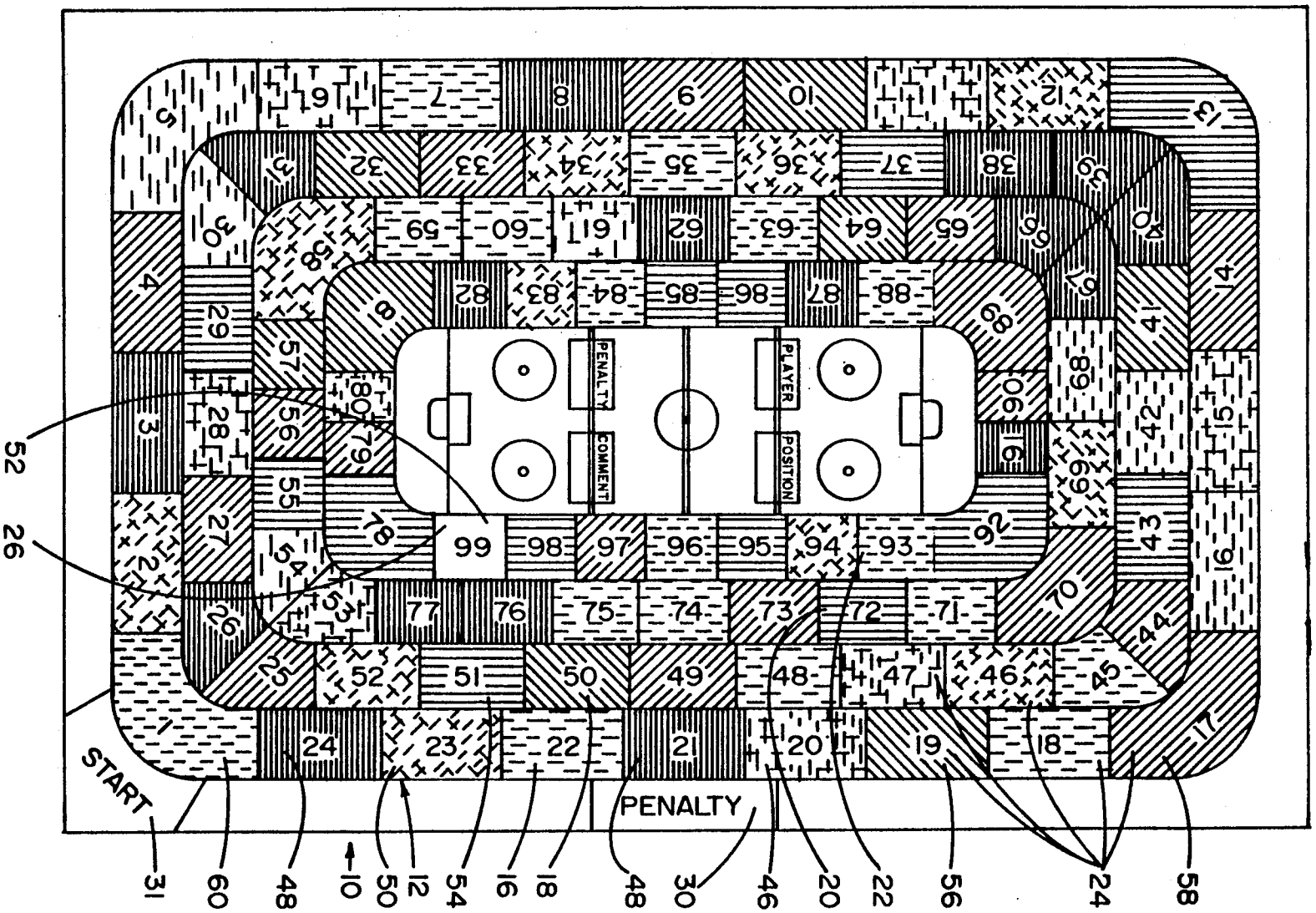
FIG. 1 is a plan view of a game board.

Referring to the accompanying drawings, FIG. 1 illustrates a game board 10. The board is marked off to provide a track 12 in the form of four concentric, oblong rings, an outer first ring 16, a second ring 18, a third ring 20 and a fourth ring 22. The rings are subdivided into sequential playing areas 24. The playing areas are numbered in sequence so that upon completing a circuit of one of the rings, players continue onto the next highest number in the next adjacent inner ring. The final playing area 26 is positioned adjacent an oblong centre zone that is shaped and marked to simulate an ice hockey rink.

At one side of the outer ring is a penalty area 30. Adjacent the playing area numbered "1 ", there is a start area 31.

Figure 2:
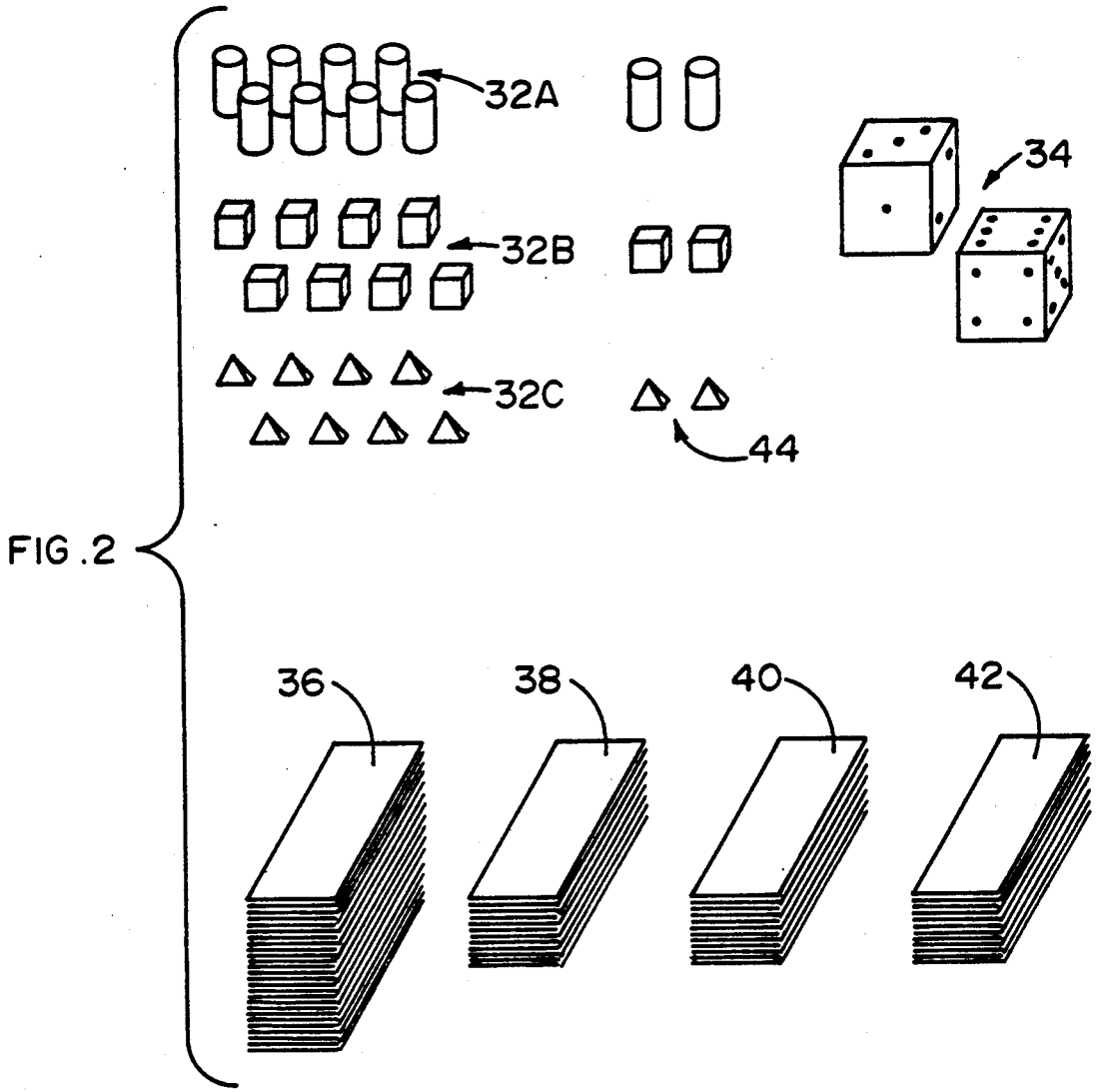
FIG. 2 is an isometric view of the game apparatus, apart from the game board.

FIG. 2 illustrates the remainder of the game apparatus. This includes several sets of tokens 32A, 32B, 32C etcetera. The number of sets equals the maximum number of game participants. The apparatus also includes a chance device in the form of a pair of dice 34. The game includes four sets of cards. These include player cards 36, position cards 38, penalty cards 40 and a set of random factor cards 42. The game is completed with a set of penalty tokens 44 that, in this case, resemble the tokens 32A, 32B etcetera but of a distinctive colour.

Each of the playing areas 24 on the game board carries indicia in the form of eight selected colours. The playing areas 46 are yellow, which correspond to the player cards 36. The playing areas 48 are red, which correspond to the random factor cards 42. The playing areas 50 are orange and correspond to the penalty cards 40. The playing area 52, the final playing area along the track is white and corresponds to the position cards 38.

The playing areas 54 are trade areas and are coloured blue. The playing areas 56 are green and are player activation areas. The playing areas 58 are brown and are offside areas. The remaining areas 60 are grey, which is a neutral stop.

Figure 3:
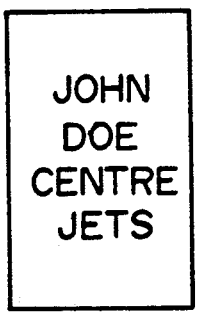
FIG. 3 is a front view of a player card.
Figure 4:
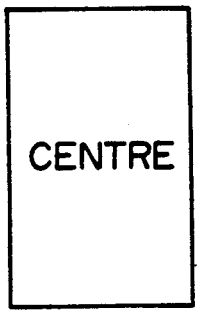
FIG. 4 is a front view of a position card.
Figure 5:
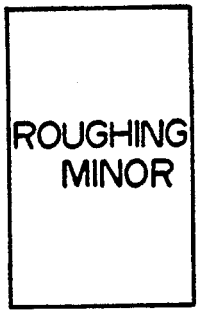
FIG. 5 is a front view of a penalty card.
Figure 6:
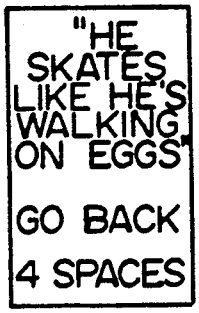
FIG. 6 is a front view of a random factor card.

As shown in FIG. 3, each player card represents a particular player and gives his position and team. As shown in FIG. 4, each of the position cards designates one of the player positions, centre, right wing, left wing, defence or goal. As illustrated in FIG. 5, each of the penalty cards states a penalty and whether it is a minor penalty or a major penalty. Minor penalties are roughing, elbowing, high sticking, interference, cross checking and tripping. Major penalties are spearing and fighting.

The random factor cards 42 are set out in the form of comments from an ascerbic sports commentator. These comments may be either favourable or negative. In the case of negative comments, the card carries an instruction to move a token backwards along the track. With a positive comment, the instruction is to advance the token along the track.

To play the game, each participant is allocated a set of tokens 32A, 32B etcetera. One of those tokens is placed on the start area 31 of the game board. A number of teams depending on the number of participants are selected from the set of player cards. The complete set includes 21 teams of 6 players each. After removing teams from the set, there should be more teams than participants. The cards remaining are then shuffled and three cards are dealt to each participant, face down. These are the participants beginning "practice roster". The remaining cards are placed in the designated location in the centre of the game board. The position cards, penalty cards and random factor cards are also shuffled and placed where designated in the centre of the board.

Once the game is set up, the participants take turns rolling one die. On rolling a one or a six, the participant rolls one or two dice at his option and moves a token along the track a number of playing spaces equal to the number rolled on the dice. The player also turns over one of the cards from his assigned practice roster. The face up player card becomes part of the active roster assigned to the participant in question. When the token lands on a playing area of a particular colour, the player must then act accordingly. The playing area colours and the actions to be taken are as follow:

Yellow—Player select

When a participant's token lands on a yellow playing area, the participant takes a player card from the top of the player card set. The card is placed face down on the participant's practice roster. The participant's turn end and the dice are passed to the next participant.

Green—Player activate

When a participant's token lands on a green playing area, the participant selects a card from his practice roster and then turns it face up as an addition to the participant's active roster. The participant then rolls one or two of the dice and starts a new token along the track.

If the participant does not have a practice roster, there is no activation of a new player and no new token is started. The participant's turn ends and the dice are passed to the next participant.

White—Position

When a participant's token lands on the final playing area along the track, the participant selects a card from the position card set 38. If the participant has a player on his active roster with the same position as that shown on the selected position card, the token is taken from the final playing area and placed on the active roster player in question. This then becomes a "completed" player, part of the participant's complement. The position card is returned to the bottom of the set and the dice are passed to the next participant.

If the participant does not have an active player with the selected position, the participant's turn end and the position card is returned to the bottom of the set of position cards. On the participant's next turn, rolling a one or six with one die provides the opportunity to take a position card from the set of cards 38 in an attempt to complete one of the players on the active roster. On rolling a number other than one or six, the participant may then move any other of his tokens that may be on the track.

In order to land on the final playing area, the roll of the die or dice must be exact.

The first participant to complete a full complement of six players from the same team is the winner of the game.

Blue—Trade

When a participant's token lands on a blue playing area, the participant has the option of trading a player from the participant's active roster with a player from the active roster of any other participant. The trade is solely at the option of the participant whose token landed on the blue playing area. The other participants have no say in the matter. When a trade is completed, the participant's turn is complete and the dice are passed to the next participant.

If the participant chooses not to excercise the trade option, the participant rolls the die or dice once more and moves the token along the track according to the numbers on the dice.

Orange—Penalty

When a participant's token lands on an orange playing area, the participant draws a card from the "penalty" set. If the card reads "penalty shot" the participant rolls the die or dice and moves a token appropriately. If the penalty card specifies a penalty, the token is taken from the track and replaced with one of the penalty markers 44. The removed token is placed in a penalty area 30. The dice are then passed to the next participant. The participant continues to take regular turns while the token remains in the penalty area. The token is removed from the penalty area and returned to the track if the participant rolls a one or a six on one die. The participant is not allowed to move other tokens that may be on the track while one of his tokens is the penalty area. If the participant fails to roll a one or a six after three turns, the penalty is considered over and the token is returned to the track.

On returning a token to the track after a minor penalty, the participant rolls the die or dice and moves the token that has been returned to the track according to the number on the die. In the event of a major penalty, there is no additional roll once the token has been returned to the track.

The penalty card is retained until the token has been returned to the track from the penalty area. At that time, the penalty card is returned to the bottom of the set of penalty cards.

Brown—Offside

The brown playing areas represent a technical infraction, an offside, for which there is no penalty. When a player's token lands on a brown playing area, the token is moved backwards along the track to the preceding brown playing area or eight spaces if there is no preceding brown playing area. Upon completing the backward movement of the token, the participant's turn is over and the dice are passed to the next participant.

Red—Random Factor

When a participant's token lands on a red playing area, the participant draws a card from the random factor set and either moves the token rather forwardly or backwardly along the track according to the directions given on the card selected. If the token is advanced, the participant then rolls the die or dice again and moves a token to complete the participant's turn.

Gray—Neutral

When a participant's token lands on a gray playing area, there is no specific action to be taken. The participant rolls the die or dice once more to continue the participant's turn.

GENERAL RULES FOR TOKEN MOTION

A participant has a choice of moving any active token on any of this turns. However, on any given turn the participant may not move more than one token. The only exception to this rule is where a participant's token lands on green and a new token is started.

The tokens of different participants may occupy a single playing area at one time. The exception to this is the final playing area where a token of one participant moving to that playing area may "bump" another participant's token back to the first playing area. One participant may have two or more tokens on the final playing area.

It is the participant's choice to use one or two dice in moving tokens around the board.

While one particular embodiment of the present invention has been described in the foregoing, it is to be understood that other embodiments are possible within the scope of the invention. Thus, the game may be set up in relation to other team sports. A number of detailed variations in the apparatus and the rules of play are also possible. The invention is therefore not to be considered limited to the embodiment described in the foregoing. The invention is limited solely by the scope of the appended claims.

What is claimed is:

1. An apparatus for playing a multiple participant game related to a team sport, said apparatus comprising:

player record means recording a plurality of players comprising a plurality of teams, and recording a team and a position for each player;

player acquisition means for randomly acquiring individual players from the player record means;

position record means recording each position in a complement of players;

position designation means for randomly designating individual positions from the position record means;

track means comprising a plurality of sequential playing areas;

participant token means representing each participant;

chance means operable to produce a random representation of movement of the token means along the track;

player addition indicia associated with selected ones of the playing areas of the track for directing transfer of a player acquired by the player acquisition means from the player record means to a participant roster; and position selection indicia associated with at least one of the playing areas for directing the designation of a position with the position designation means.

2. An apparatus according to claim 1 wherein the token means comprise plural tokens for each participant.

3. An apparatus according to claim 2 including player activation indicia associated with at least one of the playing areas for directing the placement of an additional participant token on the playing track means.

4. An apparatus according to claim 3 including penalty indicia associated with at least one of the playing areas for directing a participant to serve a penalty.

5. An apparatus according to claim 4 including penalty record means recording a plurality of penalties and a penalty designation means for random designation of penalties from the penalty record means.

6. An apparatus according to claim 1 including procedural infraction indicia associated with at least one of the playing areas for directing movement of a token along the track means.

7. An apparatus according to claim 1 including trade indicia associated with at least one of the playing areas for permitting an exchange of players between participant rosters.

8. An apparatus according to claim 1 including random factor record means recording instructions for moving participant tokens along the track and random factor indicia associated with at least one playing area for directing the random selection of a token movement from the random factor record means.

9. An apparatus according to claim 1 wherein the the player designation means comprise a set of cards, and the player record means comprise indicia on each card recording a respective player and the team and position for the player.

10. An apparatus according to claim 1 including a game board, the track means comprising a track marked on the board.

11. An apparatus according to claim 1 wherein the position selection indicia is associated solely with a final playing area along the track.

12. An ice hockey board game apparatus for multiple participants, said apparatus comprising:

a set of player cards, each card recording player data including a team and a position;

selectively actuable position designation means for randomly designating the positions of players in a complement of ice hockey players;

a game board having a track marked thereon, the track comprising a plurality of sequential playing areas;

player addition indicia associated with selected ones of the playing areas for directing selection of a player card;

participant token means movable along the track of the playing areas; and chance means for directing movement of the token means around the track.

13. A method of playing a multiple participant game related to a team sport, said method comprising:

(a) providing a playing track comprising a plurality of sequential playing areas including a plurality of player addition areas and at least one position selection area; a plurality of sets of participant tokens, one set for each participant; player record means recording each player, the player's team and the player's position; position designation means for randomly designating the player positions; and a chance device;

(b) for a first participant, actuating the chance device to produce token movement data;

(c) moving a token of the first participant along the track according to the data produced by the chance device;

(d) if the token falls on a player addition area, selecting a player from the player record means and adding the player to a roster assigned to the first participant;

(e) if the token falls on a position selection area, designating a player position with the player position designation means;

(f) selecting a player of the same position as the designated position from the roster assigned to the first participant and transferring that player to a player complement of the first participant;

(g) repeating steps (b) to (f) for each participant and repeating the sequence until one participant has completed a complement of players from the same team.

14. A method according to claim 12 wherein the playing areas include at least one pair of activation areas and comprising, when a token falls on a player addition area adding a player from the player record means to a practice roster assigned to the participant and when the participant's token falls on a player activation area transferring a player from the practice roster to an active roster assigned to the participant.

15. A method according to claim 14 further comprising placing a further token of a participant on the track when the participant's token falls on a player activation area.

16. A method according to claim 15 comprising selecting players for transfer to a participant's player complement from the participant's active roster.

17. A method according to claim 13 wherein the playing areas include at least one trade area and comprising exchanging players between the rosters of two participants when a token of one of the players falls on a trade area.

18. A method according to claim 13 wherein the playing areas include at least one penalty area and comprising penalizing a participant when the participant's token falls on the penalty area.

19. A method according to claim 18 comprising providing penalty record means recording penalties that may be assessed against a participant and randomly selecting one of the penalties and assessing the selected penalty against a participant when the participant's token falls on a penalty area.

20. A method according to claim 13 wherein the playing areas include a procedural infraction area and comprising moving a token backwards along the track when the token lands on a procedural infraction area.

21. A method according to claim 13 wherein the playing areas include a random movement area and comprising providing random movement record means recording a plurality of a token movement, selecting a movement at random from the random movement record means when a token falls on the random movement area and moving the token according to the selected movement.

* * * * *